US006575553B1

(12) United States Patent
Williams et al.

(10) Patent No.: US 6,575,553 B1
(45) **Date of Patent: *Jun. 10, 2003**

(54) INKJET RESIDUE CLEANING SYSTEM FOR INKJET CARTRIDGES

(75) Inventors: Kenneth R. Williams, Vancouver, WA (US); Ernesto Garay, Gresham, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/560,430

(22) Filed: Apr. 28, 2000

Related U.S. Application Data

(63) Continuation of application No. 08/961,050, filed on Oct. 30, 1997, now abandoned.

(51) Int. Cl.[7] ..... B41J 2/165

(52) U.S. Cl. ..... 347/22; 347/33; 347/50; 347/86

(58) Field of Search ..... 347/22, 32, 33, 347/49, 50, 86, 108; 15/250.361

(56) References Cited

U.S. PATENT DOCUMENTS

| | | | | |
|---|---|---|---|---|
| 5,559,539 A | | 9/1996 | Vo et al. | 347/33 |
| 5,598,194 A | | 1/1997 | Hall et al. | 347/50 |
| 5,774,139 A | * | 6/1998 | Salzer et al. | 347/32 |
| 5,907,335 A | | 5/1999 | Johnson et al. | 347/33 |
| 5,936,647 A | * | 8/1999 | Rhodes et al. | 347/29 |
| 6,132,037 A | * | 10/2000 | Bartolome et al. | 347/87 |
| 6,155,667 A | * | 12/2000 | Eckard et al. | 347/33 |

FOREIGN PATENT DOCUMENTS

| | | | |
|---|---|---|---|
| EP | 0498579 | 8/1992 | 347/33 |
| EP | 0597677 | 5/1994 | |
| EP | 0709204 | 5/1996 | |
| EP | 0805028 | 11/1997 | |
| EP | 0900661 | 3/1999 | |
| JP | 4320852 | 11/1992 | 347/33 |
| JP | 09150521 | 6/1997 | |

OTHER PUBLICATIONS

Hewlett Packard Journal, "Printer Cartridge Fixturing and Maintenance in the HP Deskjet 1200C Printer", by Dangelo et al., Feb. 1994.

Copy of European Patent Office, European Search Report from related European Application No. 98308581, filed Jan. 1999., Widmeier, W.

* cited by examiner

*Primary Examiner*—Shih-Wen Hsieh

(57) ABSTRACT

An electrical interconnect cleaning system cleans an electrically conductive ink residue from a portion of an inkjet cartridge upon removal from an inkjet printing mechanism to prevent short circuiting of the interconnect conductors across the ink residue. In a passive carriage-based version of the system, a spring-biased wiper arm extends from a carriage which holds the cartridge and pushes a wiper head into wiping contact with the interconnect when the cartridge is removed from the carriage. In an active service station-based version of the system, an L-shaped wiper is brought into wiping contact with the electrical interconnect through motion of the service station platform, which also supports appliances for servicing a printhead portion of the cartridge. A method of cleaning this ink residue from the cartridge, and an inkjet printing mechanism having such an electrical interconnect cleaning system are also provided.

23 Claims, 6 Drawing Sheets

INKJET RESIDUE CLEANING SYSTEM FOR INKJET CARTRIDGES

CROSS-REFERENCE TO RELATED APPLICATION(S)

This is a continuation of application Ser. No. 08/961,050 filed on Oct. 30, 1997 now abandoned.

FIELD OF THE INVENTION

The present invention relates generally to inkjet printing mechanisms, and more particularly to an electrical interconnect cleaning system that cleans ink residue from a portion of an inkjet cartridge upon removal from the printing mechanism to prevent short circuiting of the interconnect conductors across the conductive ink residue.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station " mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being, connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary, location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads, which must be done without any appreciable wear that could decrease printhead life. To accomplish this objective, use of an ink solvent has been proposed. In this proposed system, the ink solvent, a polyethylene glycol ("PEG") compound is stored in a porous medium having an applicator portion that applies the solvent to the printhead wiper. The wiper moves across the applicator to collect PEG, which is then wiped across the printhead to dissolve accumulated ink residue and to deposit a non-stick coating of PEG on the printhead face to retard further collection of ink residue. The wiper then moves across a rigid plastic scraper to remove dissolved ink residue and dirtied PEG from the wiper before beginning the next wiping stroke. The PEG fluid also acts as a lubricant, so the rubbing action of the wiper does not unnecessarily wear the printhead.

During printing and spitting, some small ink droplets may become airborne within the printer, forming what is known as "ink aerosol." Unfortunately, this ink aerosol often lands in undesirable locations on the inkjet cartridge that are not normally cleaned by the printhead service station. For example, this ink aerosol may collect along a portion of the cartridge exterior next to the electrical interconnect that sends the firing signals to the printhead. Moreover, the process of wiping the printhead often deposits ink on this portion of the cartridge adjacent the electrical interconnect. Beyond leaving the pen dirty with ink residue, unfortunately, many inkjet inks are also electrically conductive, so any ink smeared on the conductors of the electrical interconnect has the potential for causing a short circuit between the conductors. Ink residue deposited on the pen next to the electrical interconnect may be smeared on the interconnect conductors when the pen is removed, and then further smeared across the interconnect when a new pen is installed increasing the chances for a short circuit to occur.

The inkjet pens used in an off-axis system require special installation to align straight fluid transfer needles for insertion between the printer carriage and the printhead, so a portion of this installation must inherently have a linear motion. Thus, there is no practical way to avoid dragging this ink residue across the interconnect by employing any type of a rotational motion to move the soiled portion of the pen away from the interconnect. This inky interconnect problem is exacerbated in an off-axis system because the "mini" cartridges that carry the printheads are replaced only occasionally during the useful life of the printer, so conceivably, this residue may build-up over a period of years, in contrast to a replaceable cartridge system, which requires replacement of the cartridge when empty.

Thus, it would be desirable to have a system for cleaning the portion of the cartridge adjacent the electrical interconnect to remove any of this potentially damaging ink residue, as well as any paper or dust fibers entrapped therein, to maintain printer reliability.

SUMMARY OF THE INVENTION

According to one aspect of the present invention, an electrical interconnect cleaning system is provided for removing accumulated ink residue from a non-printing exterior portion of an inkjet cartridge in an inkjet printing mechanism. The cleaning system includes a wiper and a support member. The support member supports the wiper in a position to remove the accumulated ink residue from the non-printing exterior portion of the cartridge through relative movement of the wiper and the cartridge.

According to yet another aspect of the present invention, a method is provided for cleaning ink residue from a non-printing exterior portion of an inkjet cartridge in an inkjet printing mechanism. The method includes the step of providing a wiper supported by a support member. In response to an action by a user to remove the cartridge from the printing mechanism, in a removing step, the accumulated ink residue is removed from the non-printing exterior portion of the cartridge through relative movement of the wiper and the cartridge.

According to a further aspect of the present invention, an inkjet printing mechanism may be provided with an electrical interconnect cleaning system as described above.

An overall goal of the present invention is to provide an inkjet printing mechanism which prints sharp vivid images over the life of the printhead and the printing mechanism, particularly when dispensed from an off-axis system.

Another goal of the present invention is to provide an electrical interconnect cleaning system for cleaning ink residue from a potentially harmful location on the exterior of an inkjet cartridge installed in an inkjet printing mechanism, before the cartridge is removed from the printing mechanism to provide consumers with a reliable, economical inkjet printing unit.

BRIEF DESCRIPTION OF THE DRAWINGS

FIGS. 4, 5 and 6 are side elevational views illustrating the service station based form of the electrical interconnect cleaning system of FIG. 2, with:

FIG. 4 showing a first step of the cleaning operation;

FIG. 5 showing an intermediate step; and

FIG. 6 showing a final step.

FIGS. 7 and 8 are side elevational views of a second form of an electrical interconnect cleaning system of the present invention, here, a carriage based form of the system in the printer of FIG. 1, shown cleaning an inkjet cartridge, with:

FIG. 7 showing the system before cleaning; and

FIG. 8 showing this system during the cleaning process.

DETAILED DESCRIPTION OF A PREFERRED EMBODIMENT

Figure 1:
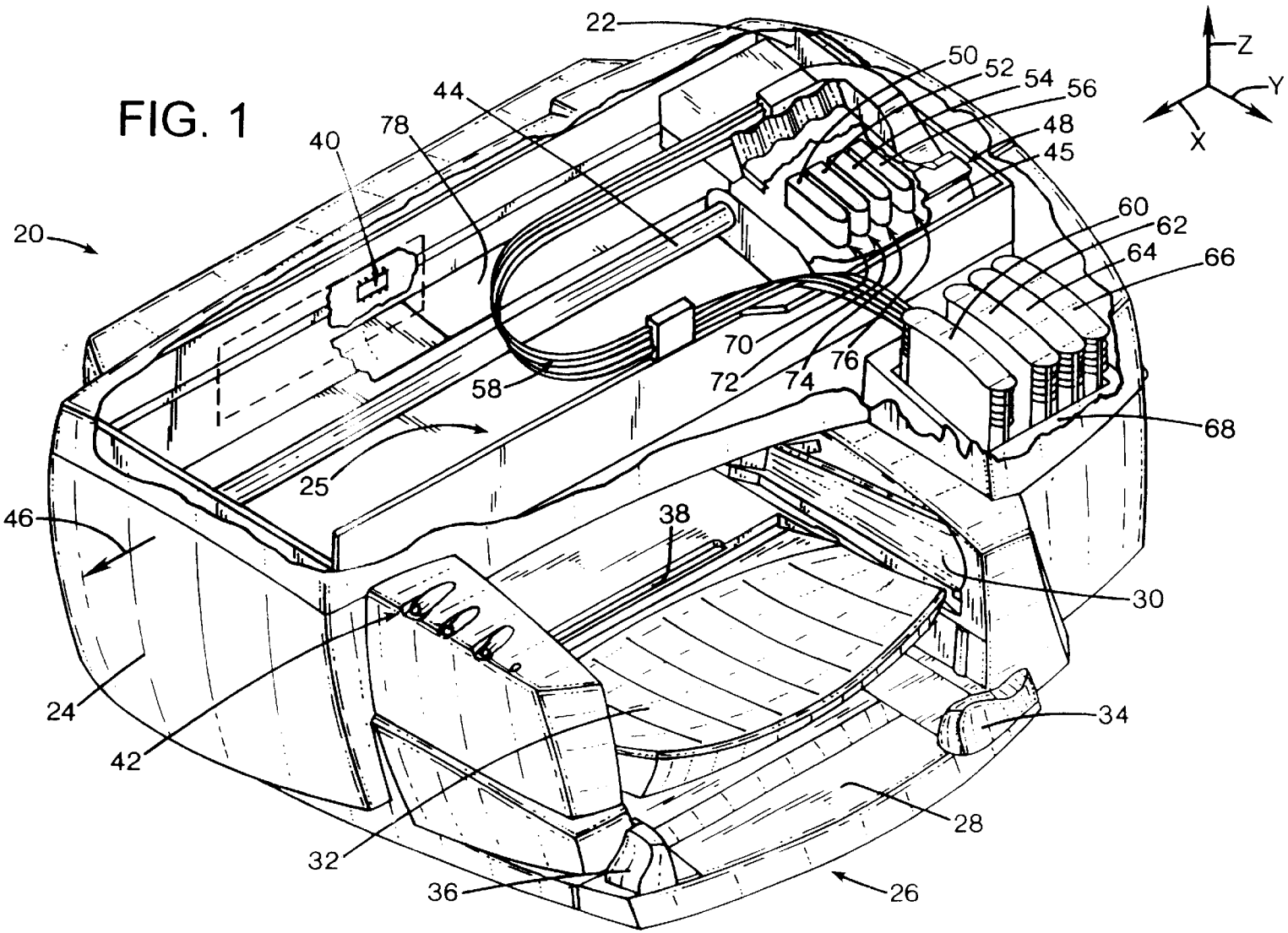
FIG. 1 is a perspective view of one form of an inkjet printing mechanism, here, an inkjet printer, including an electrical interconnect cleaning system of the present invention for cleaning ink residue from a potentially harmful location on the exterior of an inkjet cartridge installed in an inkjet printing mechanism, before the cartridge is removed therefrom.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shone). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
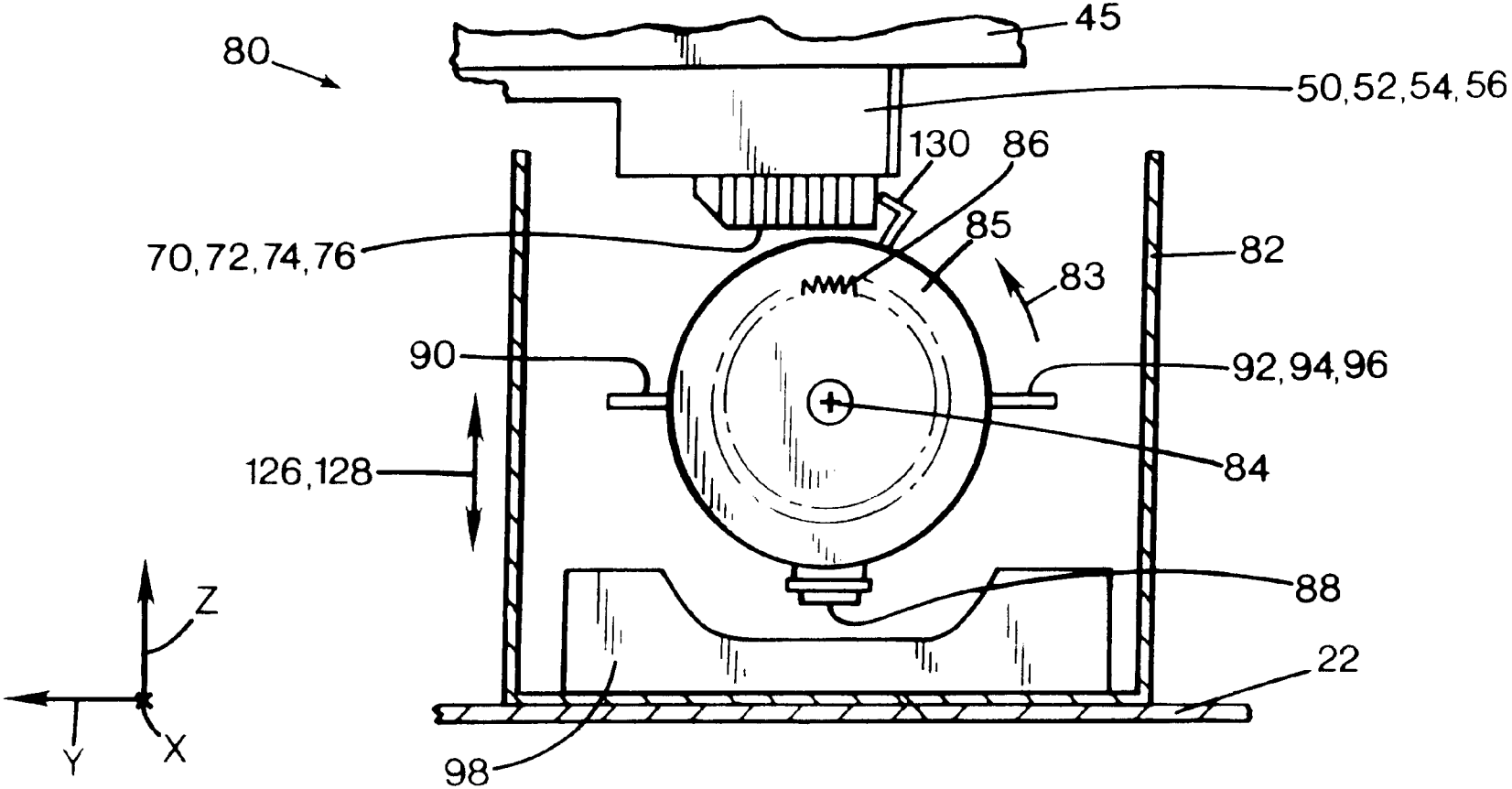
FIG. 2 is a side elevational view of a first form of an electrical interconnect cleaning system of the present invention, here, a service station based form of the system in the printer of FIG. 1, shown cleaning an inkjet cartridge.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

FIG. 2 illustrates one form of a dual-blade wiping service station 80 constructed in accordance with the present invention. The service station 80 includes a frame 82 which is supported by the printer chassis 22 in the servicing region 48 within the printer casing 24. To service the printheads 70–76 of the pens 50–56, the service station 80 includes a moveable platform supported by the service station frame 82. Here, the servicing platform is shown as a rotary member supported by bearings or bushings (not shown) at the service station frame 82 for rotation, as illustrated by arrow 83, about an axis 84, which in the illustrated embodiment is parallel with printhead scanning axis 46. The illustrated rotary member comprises a tumbler body 85 which may have a drive gear 86 that is driven by a conventional service station motor and drive gear assembly (not shown). The tumbler 85 carries a series of servicing components, such as a capping assembly 88, into position for servicing the printheads 70–76. The capping assembly 88 preferably includes four discrete caps for sealing each of the printheads 70–76, although only a single capping unit is visible in the view of FIG. 2. The tumbler 85 may also be mounted to the service station frame 82 for movement in a vertical direction, as indicated by the double-headed arrow in FIG. 2, to facilitate capping. Alternatively, the capping, assembly 88 may be mounted to the tumbler 85 to move upwardly away from tumbler 85 when moved into contact with the pens 50–56 or the carriage 45, for instance, using the capping strategy first sold by the present assignee, Hewlett-Packard Company of Palo Alto, Calif., in the models 850C and 855C DeskJet® inkjet printers.

Other servicing components carried by the rotary platform 85 include a black dual-blade wiper 90 for servicing the black printhead 70, and three color dual-blade wipers 92, 94 and 96 for servicing the respective color printheads 72, 74 and 76, although in the side view of FIG. 2, the yellow wiper 96 obscures the view of the cyan and magenta wipers 92, 94. Preferably, each of the wipers, 90–96 is constructed of a flexible, resilient, non-abrasive, elastomeric material, such as nitrile rubber, or more preferably, ethylene polypropylene diene monomer (EPDM), or other comparable materials known in the art. For wipers 90–96, a suitable durometer, that is, the relative hardness of the elastomer, may be selected from the range of 35–80 on the Shore A scale, or more preferably within the range of 60–80, or even more preferably at a durometer of 70 +/−5, which is a standard manufacturing tolerance.

By placing the black wiper 90 along a different radial location on tumbler 85 than the radial on which the color wipers 92–96 are located, here, with the black and color wipers being shown 180° apart for the purposes of illustration, advantageously allows different wiping schemes to be employed for cleaning the black printhead 70 and for cleaning the color printheads 72–76. For instance, the color pens 52–56 carrying dye-based inks may be wiped using a faster wiping speed than required for wiping the black pen 50 which dispenses a black pigment-based ink. In the past, many service stations used wipers that required both the black and color printheads to be wiped simultaneously, so compromises had to be made between the optimum wiping speeds for the black pigment-based ink and the color dye-based inks. Problems were encountered in the past because the slower wiping strokes required to clean the black printheads extracted excess ink from the color printheads. When using a faster wiping stroke for the color pens, without allowing excess time for the color ink to seep out between the orifice plate and the wipers, the black wiper would then skip over black ink residue on the black printhead. These problems are avoided by service station 80, which places the black wiper 90 and the color wipers 92–96 at different locations around the periphery of the tumbler 85, thus allowing wiping to be optimized for both the black printhead 70 and for the color printheads 72–76.

As mentioned in the Background section above, the advent of permanent or semi-permanent inkjet printheads for use in off-axis printers, such as printer 20, particularly those using different types of ink, such as a pigment-based black ink and dye-based color inks, has proved challenging for service station designers. New servicing approaches were required to clean and maintain the pens without unnecessarily shortening the printhead lifespan. In studying various servicing, routines, it was felt that use of an ink solvent may be the optimum approach to printhead cleaning. In particular, it would be even more desirable if the ink solvent also served to lubricate the printhead orifice plates during wiping, which would then avoid unnecessary wear or damage to the printheads, thereby insuring a long printhead life. To this end, the service station 80 includes a solvent dispensing system 98, mounted along the lower portion of the service station frame 82 in location where the wipers 90–96 can be coated with the solvent prior to wiping the printheads 70–76. The solvent dispensing system 98 also has a wiper cleaner portion to remove ink residue and any remaining solvent from the wipers after cleaning the printheads in a wiping cycle. The inkjet ink solvent used in system 98 may be a hygroscopic material, such as polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that function as humectants, absorbing moisture from the air so they will not readily dry out during extended periods of time. For the purposes of illustration, the preferred ink solvent used in system 98 is PEG.

Figure 3:
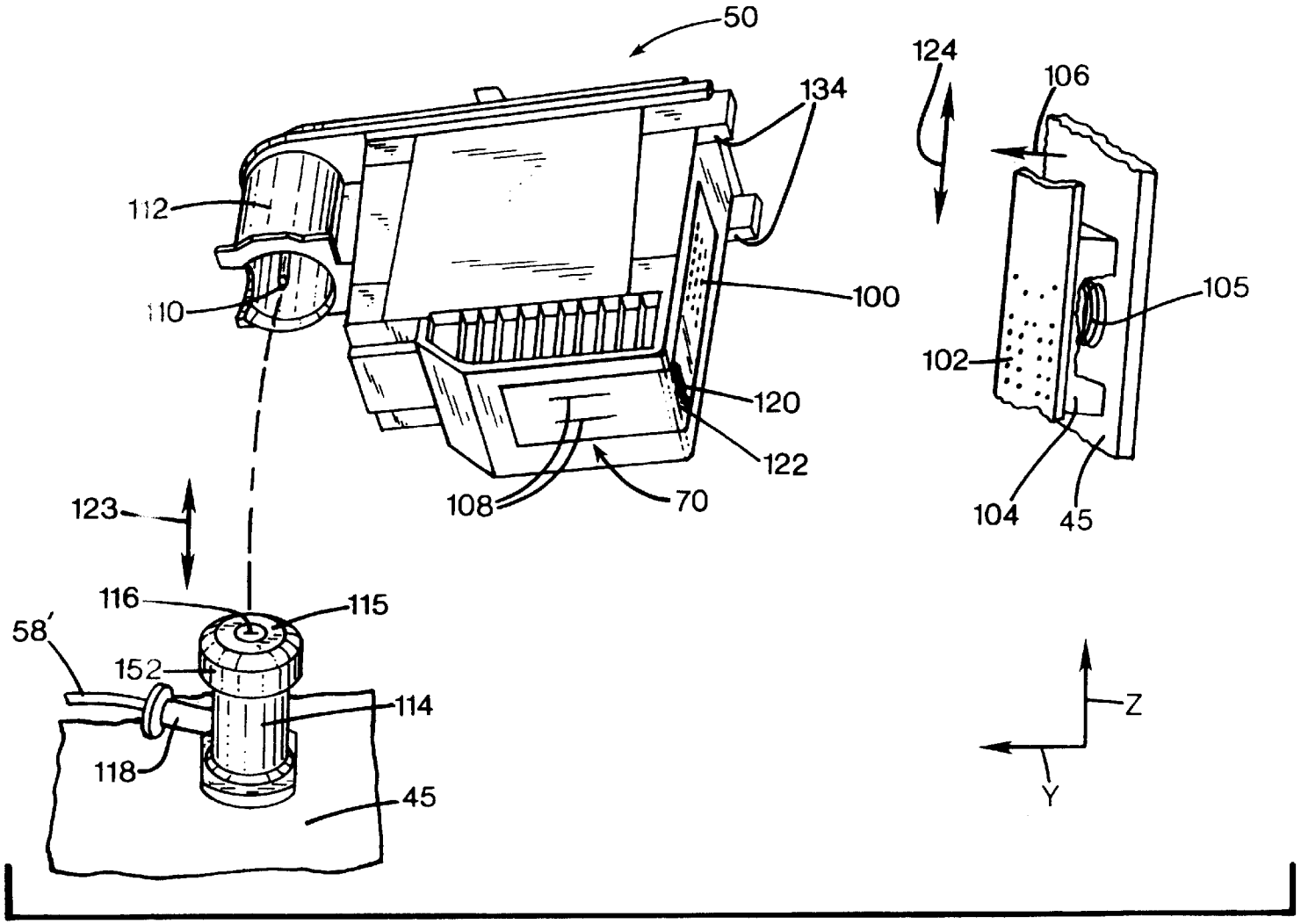
FIG. 3 is an exploded, perspective view showing various components of the printer of FIG. 1, specifically, showing an bottom and rear perspective view of an inkjet cartridge, an ink coupling for fluidically coupling the cartridge with an ink source of the printer, and an electrical interconnect portion of a carriage which holds the cartridge.

FIG. 3 illustrates several details of the manner in which the pens 50–56 are installed within the carriage 45. For the purposes of illustration, the black pen 50 is shove, and the concepts illustrated herein are typical to pens 52, 54, and 56. The pen 50 includes an electrical interconnect 100 located along a rearward facing portion of the cartridge. The electrical interconnect 100 comprises a flexible strip which has a series of conductive contact pads located to be in electrical contact with a series of matching contact pads on a flex strip 102 mounted along an interior portion of the carriage 45. To provide a solid physical contact between the pads of the pen flex strip 100 and the carriage flex strip 102, preferably the carriage flex 102 is mounted above a pusher member 104, which is biased by a spring 105 to push the carriage flex strip 102 into contact with the pen flex 100, as illustrated by arrow 106 in FIG. 3.

A variety of other mechanisms have been used over the years for pushing the carriage flex conductors into contact with the pen flex conductors, so the spring 105 is shown merely as a presently preferred embodiment for accomplishing this action, and it is apparent that a variety of other mechanisms may be substituted for the spring 105. The pen flex 100 carries the electrical signals received from the carriage flex 102 to the firing resistors which heat the ink to eject droplets from nozzles 108 of printhead 70. In the illustrated embodiment, the nozzles 108 are arranged as two substantially linear arrays which are perpendicular to the scan axis 46 when pen 50 is installed in carriage 45.

To allow the pen 50 to receive black ink from the main storage reservoir 60 in the illustrated off-axis printer 20, the pen 50 has a straight, hollow inlet needle 110, located along a forward portion of the pen 50. The needle 110 is guarded by a shroud 112 to prevent an operator's fingers from inadvertently coming in contact with the needle. The carriage 45 also supports an inlet valve 114, which has an elastomeric septum 115 defining a preformed slit 116 therethrough. The valve 114 also has a flanged inlet port 118, to which a black ink tube 58' is coupled to receive black ink from the main reservoir 60, The black ink tube 58' is part of the tube assembly 58 in FIG. 1 that delivers ink from each of the main reservoirs 60–66 to the respective pens 50–56.

As mentioned in the Background section above, during printing some of the ink droplets ejected from the nozzles 108 never reach the print media during printing or a spittoon portion (not shown) of the service station 80 during a spitting cycle, but instead these droplets become floating ink aerosol satellites. This ink aerosol floats until it eventually lands, often on one of the printer components. One exposed region of the pen 50 which is not cleaned by the conventional, service station black printhead wiper 90, is shown in FIG. 3, where ink residue 120 has accumulated and collected along a lower nose portion 122 of the pen flex strip 100.

Moreover, the act of wiping the printhead 70 with wiper 90 also deposits ink on this nose portion 122 in two different ways. The first type of deposit, known as "flicked ink," occurs when wiping the printhead 70 by moving the wiper toward the rear of the printer 20, that is, to the right or negative Y direction in FIG. 3. After the end tip of flexed wiper 90 clears the edge of the printhead 70, the elastomeric nature of the wiper tries to return to an upright rest position. but instead over-compensates, first by flexing to the far right, then unfortunately by swinging back to the left, eventually dampening out to an upright rest position. During the return-stroke portion of this dampening travel, the wiper flicks ink residue back on the interconnect nose 122. The second type of wiper deposit, known as "wiper scrape," occurs when wiping the printhead 70 in the opposite direction toward the front of printer 20, that is, to the left or positive Y direction in FIG. 3. Here, the wiper 90 actually contacts the nose 122 because there is a mandatory interference fit between the wiper and the printhead face, which is required to flex the wiper into wiping contact with the printhead. Thus, the wiper scrapes any ink residue on the front surface of the blade directly onto the nose 122.

While the problem of this ink residue 120 shorting out the electrical contacts of the interconnect was mentioned briefly in the Background section above, now the construction of the interface of the pen 50 with carriage 45 is more fully understood, the severity of this problem is more fully appreciated.

The inlet needle 110 on the pen 50 is rigidly mounted within the shroud to pierce the septum 115 along slit 116 during pen installation. The shroud 112 is sized to surround the valve 114. While the valve 114 is preferably constructed to tilt slightly with respect to the carriage 45, it is apparent from this construction that insertion of needle 110 into septum 115, as well as removal therefrom, must use a substantially linear motion as indicated by arrow 123 in FIG. 3. Thus, if pen installation/removal for the inlet valve 114 at the front of the cartridge must be in a substantially vertical direction 123, then installation/removal at the rear of the cartridge where the electrical interconnect is located must also be vertical, as illustrated by arrow 124 in FIG. 3.

Depending upon the amount of use, after several years it may be desirable to replace the pens 50–56, because, while the desire is to have a permanent system for printheads 70–76, they may be more of a semi-permanent nature, or a user may wish to switch to different types of ink, requiring the pens 50–56 to be removed from carriage 45. Given the extended life of pens 50–56 over the earlier replaceable cartridges, these off-axis pens 50–56 reside within printer 20 for an extended period of time, which exposes the cartridge nose 122 for a long time to accumulate a significant amount of ink residue 120. Recall the pens 50–56 must be installed vertically, as indicated by arrows 123 and 124, so if ink residue 120 remains on the nose 122 during removal this residue may be smeared along the contact pads of the carriage interconnect 102, which is pushed into the path of pen removal by the biasing spring 105.

Unfortunately, the inks used in inkjet printers often have an electrically conductive nature, so ink residue smeared between contact pads of the carriage interconnect 102 may form an electrical bridge between those contact pads, causing them to short out. Then when a fresh pen is installed vertically, the spring 105 again pushes the carriage interconnect 102 into contact with the interconnect 100 of the fresh cartridge, smearing this ink residue across both interconnects 100 and 102. With this smeared ink now smeared randomly between the contact pads, there exists a likelihood that two or more the contact pads of interconnects 100, 102 may become shorted out, causing nozzles to either not fire or to misfire, either occasion of which severely degrades print quality. Worse yet, this short circuit condition may permanently damage the printhead, the printer 20, or both.

Now that the severity of the ink accumulation 120 is fully realized, preferred embodiments of two systems and methods of removing this ink residue 120 from the cartridge nose 122 will be described.

Active, Service Station Based Interconnect Cleaning System

Figure 4:
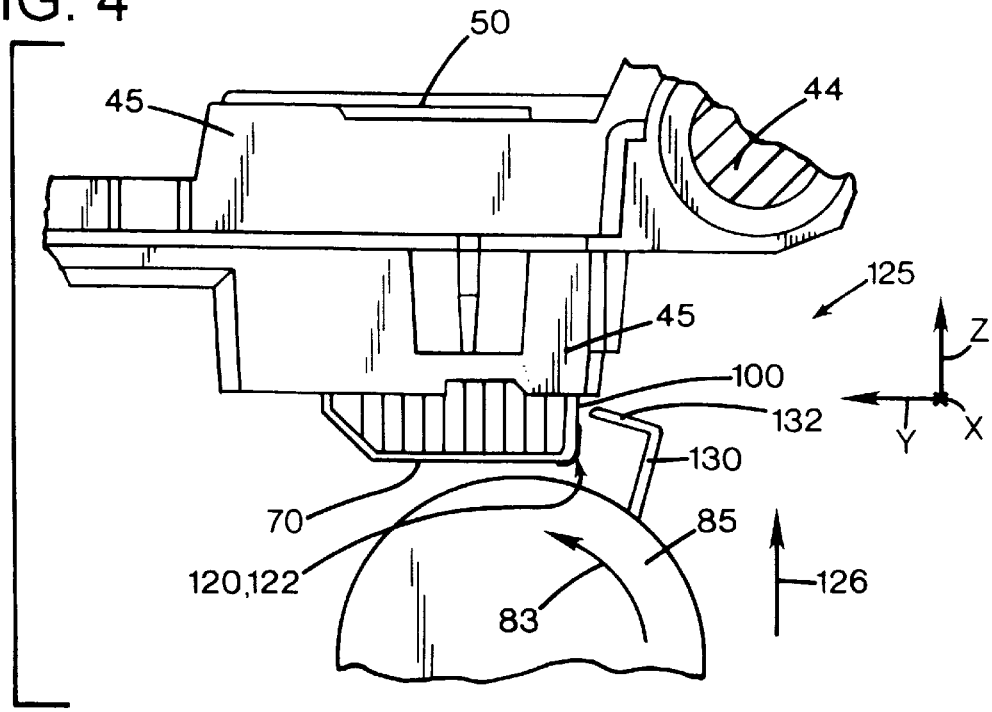
Figure 5:
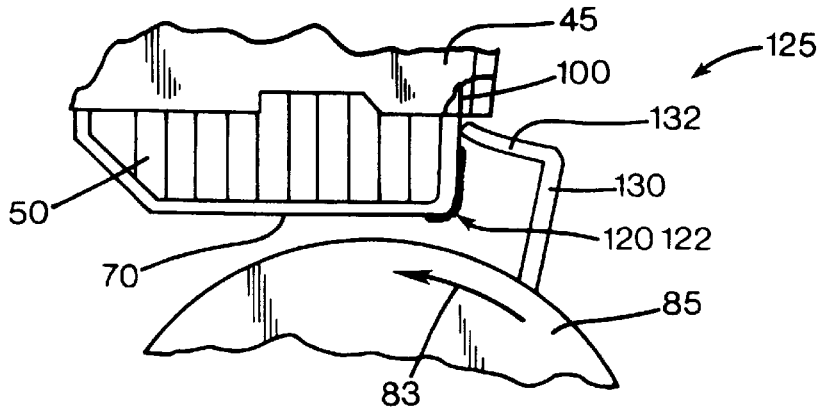
Figure 6:
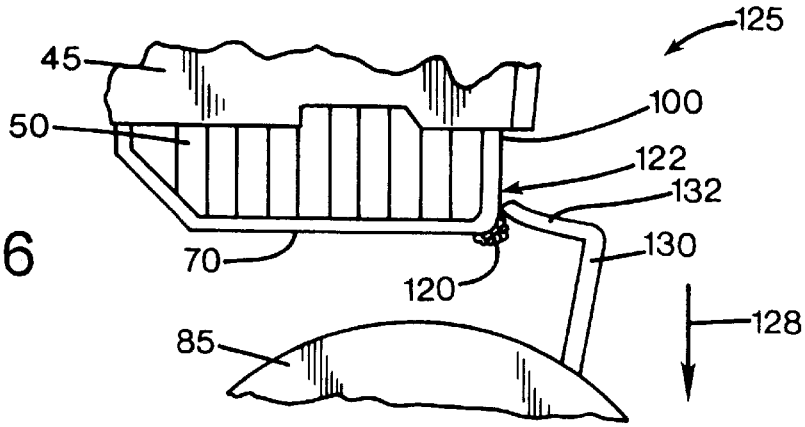

First, in FIGS. 4–6 a service station based, active electrical interconnect cleaning system 125 constructed in accordance with the present invention is illustrated. Here, the service station 80 includes an L-shaped interconnect wiper member 30 extending from the tumbler 85 to terminate in a wiping arm 132. In FIG. 4, we see the tumbler 85 has been moved toward the printhead, as indicated by arrow 126. FIG. 5 shows the next step of this active interconnect cleaning process. where the tumbler 85 has been rotated, as indicated by arrow 83, so the wiper 130 contacts the pen interconnect flex 100 to the point where the arm portion 132 is slightly flexed, to ensure an active wiping contact and engagement with the flex 100. FIG. 6 shows the next portion of this active interconnect cleaning, operation, where the tumbler 85 is retracted away from the printhead 70, here being lowered as indicated by arrow 128, to allow arm 132 to scrape the ink residue 120 from the vertical nose portion 122 of the flex 100. It is apparent that in transitioning from the position of FIG. 5 to FIG. 6, there may also be some rotation of the tumbler 85, in the direction indicated by arrow 83, but in the preferred embodiment the motion is generally linear, moving the tumbler 85 and the wiper arm 130 downwardly and away from carriage 45 to clean this vertical portion of the interconnect 100.

Following the cleaning operation of FIGS. 4–6, during vertical removal of the pen 50 from the carriage 45, the ink residue 120 has been removed from the location where it could have been smeared across the carriage interconnect 102. Now if this removed cartridge 50 is later reinstalled, the vertical portion of the flex 100 has been cleaned, so reinstallation will not contaminate the carriage flex 102 with ink residue. Moreover, upon installation of a fresh cartridge into printer 20, there will be no ink residue on the carriage flex 102 so there is no further contamination during this fresh pen installation.

The manner of initiating the active wiping sequence of FIGS. 4–6 may be easily implemented by incorporating features in to printer 20 which are currently available on a variety of commercial inkjet printers, such as the DeskJet® inkjet printers sold in the 500, 600, and 800 models series, all of which currently use replaceable cartridges. Nonetheless, these commercially available inkjet printers are provided with an interlock switch on the pen access door, which a user must open to change cartridges, and such a conventional system is included on printer 20. Rather than allowing a user to install a fresh pen into the carriage when in the capped servicing position, the design philosophy has been to move the carriage away from the servicing region 48, so upon installation of a fresh pen a user does not have to overcome the forces of the printhead capping assembly. This system assures that the pens are installed tightly against their alignment datums in the carriage without interference from the printhead caps. These pen alignment datums, such as ears 134 in FIG. 3, mate against matching carriage alignment datums to align the pen with the carriage in the X, Y and Z directions, as well as with respect to the $\theta_x$, $\theta_y$ and $\theta_z$ rotational degrees of freedom about these axes, to ensure accurate dot placement on the media.

This pen access scheme used to ensure proper alignment of the pens may advantageously be used in the active wiping system 125 of FIGS. 4–6. Upon activation of the pen access door interlock switch, which may be an optical, electrical, magnetic or some other form of switching mechanism, the printer controller 40 initiates the operation of FIGS. 4–6 to clean the interconnect nose portion 100 of pens 50–56, before moving the carriage 45 to the pen access position. Thus, only minor modifications need to be made to the pen servicing, routine, and the operation of controller 40, to implement the active interconnect cleaning, system of FIGS. 4–6. Following the steps of FIGS. 4–6, controller 40 then moves carriage 45 to the pen access position for pen removal and installation.

As a final note, it should be mentioned that each of these commercially available printers mentioned above as having such an interlock system, also have various systems to defeat pen removal in an unpowered state, so if the power cord to the printer is disconnected, the pens cannot be removed. Again, the design philosophy behind this process is to ensure that the pen datums are seated tightly against their associated carriage alignment datums, without any potential interference from the service station, and particularly from the capping mechanism of the service station. A final reason for such a pen access interlock system, is also to prevent any inadvertent damage to the service station components during installation of new pens.

Passive, Carriage Based Interconnect Cleaning System

FIGS. 7–10 illustrate one embodiment of a carriage based, passive electrical interconnect cleaning system 135, constructed in accordance with the present invention to remove ink residue 120 from the nose portion 122 of cartridges 50–56. In this passive wiping system, which requires no cooperation with the controller 40, the carriage 45 is modified to include passive wiper arms 140, 142, 144 and 146 for cleaning ink residue 120 from cartridges 50, 52, 54 and 56, respectively. The wiper members 140, 142, 144 and 146 prevent the ink residue 120 from being smeared across the associated carriage interconnects 102, 102', 102" and 102'", respectively.

Figure 7:
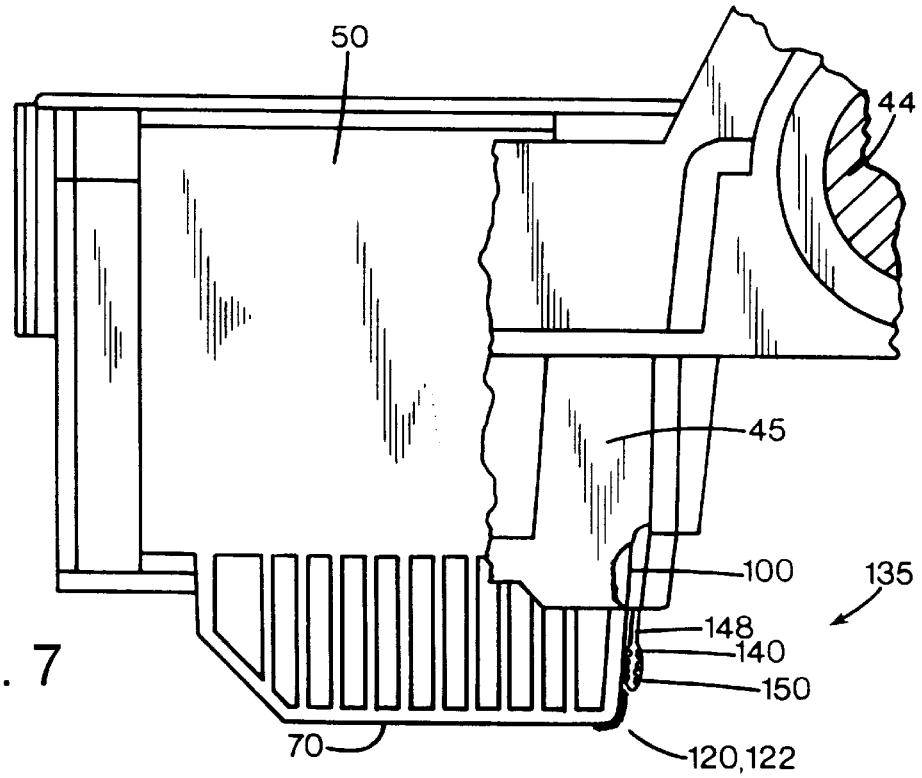
Figure 8:
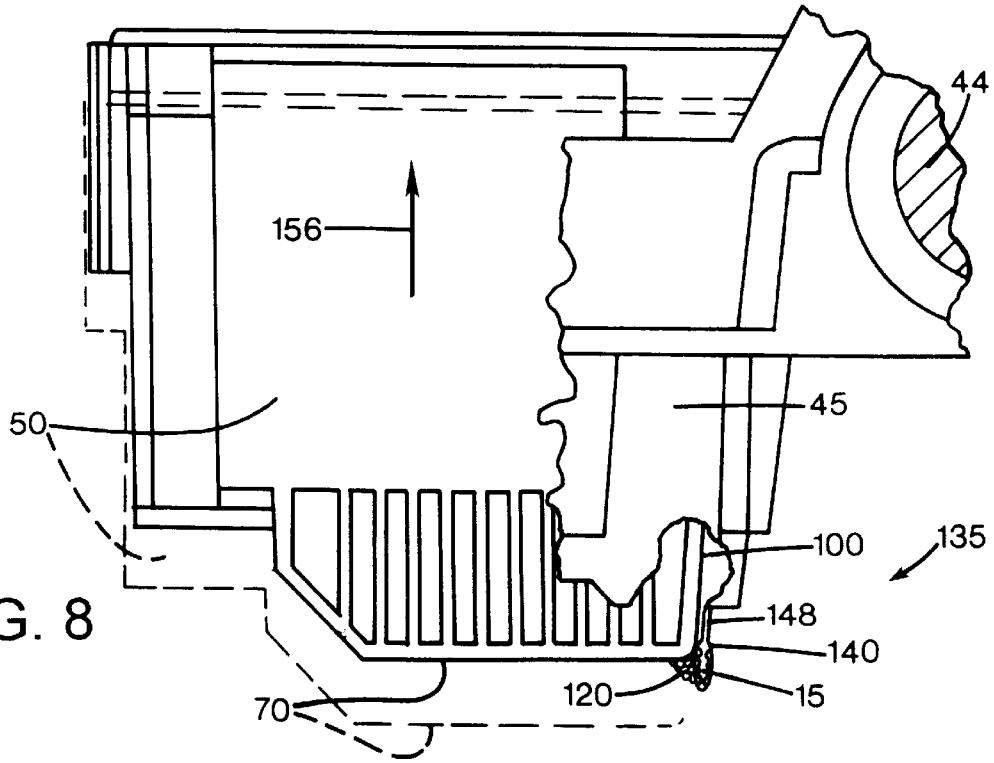
Figure 10:
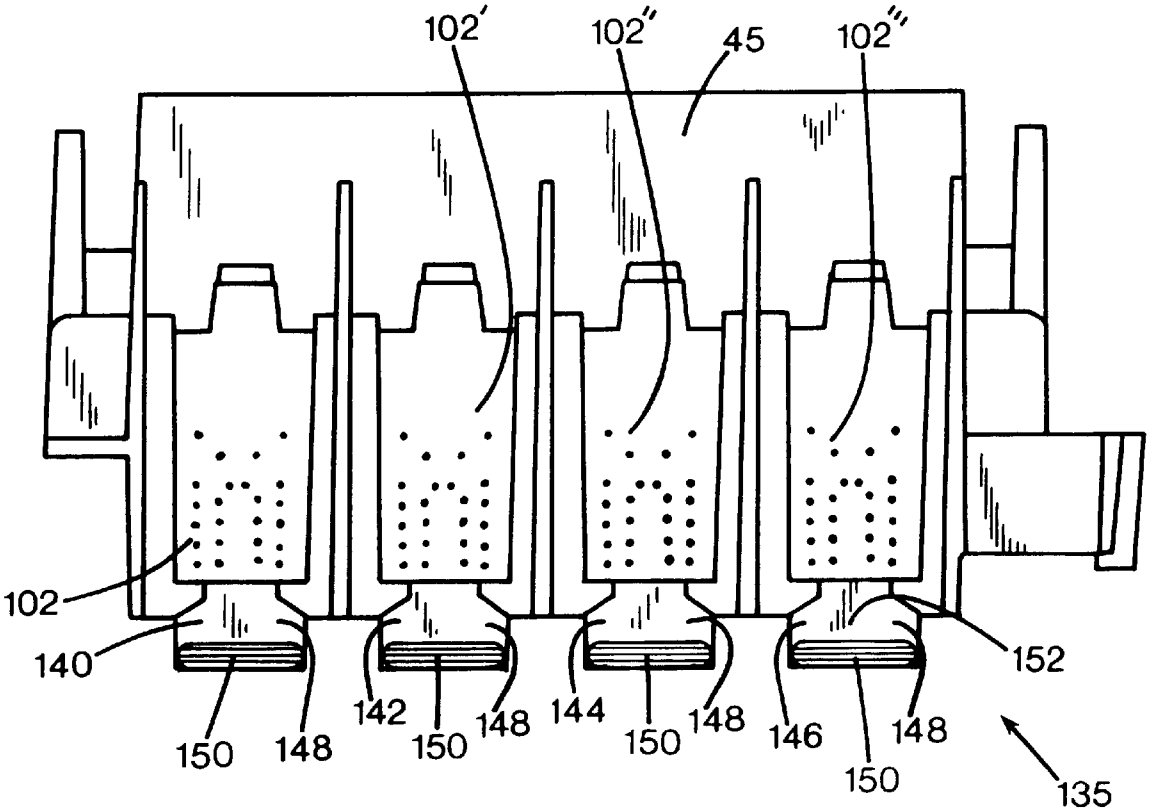
FIG. 10 is a front elevational view taken along lines 10—10 of FIG. 9.

As also shown in FIGS. 7 and 8 for the black wiper member 140, each wiper member 140–146 includes a spring arm 148 that supports a wiper head 150, preferably attached to a spatula-shaped bottom portion 152 of the spring arm 148. The spring arm 148 is preferably constructed of a spring, stainless steel, such as of a AISI 301 stainless steel alloy, half-hard rolled, such as from stock which is about 0.20 mm (0.008 inches) thick. The wiper head 150 is preferably onsert molded to the spring arm 148, using techniques known to those skilled in the art. The viper head 150 is preferably constructed of an elastomeric material as described above with respect to the printhead wipers 90–96, and most preferably of an EPDM elastomer having a durometer of 40–70, or more preferably of 50 +/−5 on the Shore A scale. Use of a material for the wiper head 150 which is the same as used for the wipers 90–96 and for the caps of assembly 88, is preferred for simplicity, and to ensure compatibility with the inks dispense by pens 50–56, although it is apparent that other ink-compatible elastomers and similar materials may be used, as known to those skilled in the art. In another embodiment, the wiper head 150 may be constructed of an absorbent, fibrous material, such as a of a blotter paper or a hard pressed cardboard which is bonded to the spring arms 140–146. One suitable absorbent wiper head 150 may be constructed from the same paperboard stock used to make beer coasters which are distributed in taverns to be placed under a customer's beverage glass.

Figure 9:
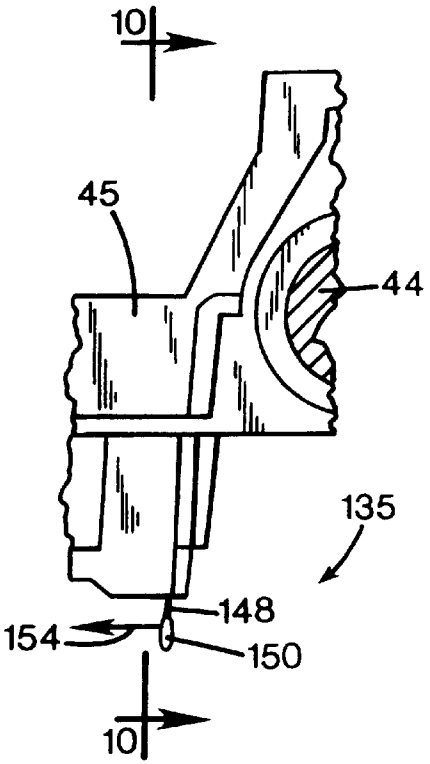
FIG. 9 is a fragmented side elevational view of the carriage based cleaning system of FIGS. 7 and 8, with the cartridge removed from the carriage.

Preferably, the spring arm 148 is constructed and installed in the carriage 45 to provide a biasing force to urge the wiper head 150 in a direction toward the pen interconnects 102–102'", as illustrated in FIG. 9 by arrow 154. This spring biasing provided by arm 148 toward the cartridges 50–56 advantageously pushes the wiper head 150 into contact with the lower nose portion 122 of the pen interconnects 100, as shown in FIG. 7. Forming the lower portion of spring arm 148 into the spatula shaped portion 152, advantageously shields a portion of the interconnect 100 from receiving the undesirable ink residue 120.

In operation, the passive electrical interconnect cleaner 135 of FIGS. 7–10 removes the accumulated ink residue 120 from the nose portion 122 of pens 50–56, as illustrated in detail with respect to FIGS. 7 and 8. FIG. 8 shows in dashed lines the initial printing position of cartridge 50, representative of all of the cartridges 50–56, with the cartridge 50 being removed as indicated by arrow 156 vertically, for the reasons described above with respect to FIG. 3. During this linear removal of pen 50, the wiping member 140 is shown with arm 148 pushing the wiper head 150 into contact with the pen flex 100, removing the ink residue 120 thereon from the vertical surface of flex 100, as shown in FIG. 8. With the vertical surface of the pen flex 100 clear of ink residue 120, the cartridge 50 may be removed from carriage 45 without smearing or depositing any of this ink residue 120 along the carriage interconnect 102. Thus, no ink residue gets deposited upon the carriage interconnect interconnect 102, so upon insertion of a fresh cartridge, there is no shorting out of the contact pads of interconnects 100, 102 by ink residue. Moreover, by removing the ink residue 120 from the vertical portion of the interconnect 100, upon reinstallation of the pen 50, the residue 120 does not become deposited upon the carriage interconnect 102. Thus, the passive interconnect cleaner system 135 of FIG. 7–10 avoids shorting out of the contact pads of interconnects 110, 102.

CONCLUSION

Thus, two electrical interconnect cleaning systems have been proposed, an active system 125 and a passive system 135 for cleaning ink, residue 120 from an exterior portion of inkjet cartridges 50–56, and here, thie nose portion 122 of the electrical interconnect 100, to prevent ink residue 120 from smearing onto critical components of the printer/carriage interface, here, the electrical interconnects 100 and 102. The passive cleaning system 135 of FIGS. 7–10 may be preferred for some implementations over the active cleaning system 125 of FIGS. 4–6, simply because the service station servicing algorithms for maintaining the health of printheads 70–76 need not be further complicated by the additional step of cleaning the interconnect with wiper member 130. Moreover, the passive system 135 imposes no additional burden on the controller 40, and imposes no additional delay of any sort before allowing a user to remove the pens 50–56 from carriage 45.

In describing the active system 120 and the passive system 135, methods have also been disclosed for cleaning this ink residue 120 from an exterior portion of the inkjet cartridge. Following an action by a user to remove an installed pen, either opening a pen access compartment to which controller 40 then responds to initiate the sequence shown in FIGS. 4–6, or by the user grasping the pen and removing it from the carriage 45 as shown in FIG. 8, the cleaning member 130 or 140–146 then physically scrapes and wipes away the ink residue 120 from this critical exterior portion 122 of pen 50–56 which is being removed from carriage 45. This cleaning operation then leaves the carriage 45, and in particular, the critical component here, the flex strip 102, free of ink residue and ready for installation of a fresh pen. Indeed, even if the removed cartridge is reinstalled, the ink residue 120 has been moved by the cleaner 130, 140–146, to the lower horizontal surface of the printhead 70–76, where it would not contact the carriage flex 102 upon reinsertion into carriage 45.

Thus, both the active cleaner system 125 and the passive cleaner system 135 advantageously clean ink residue 120 from cartridges 50–56 without requiring any user intervention beyond the normal operation of pen removal. Thus, these cleaning systems 125 and 135 are very reliable because there is no chance for a user to forget to perform these functions while changing pens. The active cleaning system 125 advantageously uses the functional abilities inherent in service station 80 for servicing printheads 70–76, and just adds four extra cleaner members 130 to the tumbler 85, one for each of the pens 50–56. Moreover, to activate the sequence of FIGS. 4–6, already installed features within commercial inkjet printers, and within printer 20, are used. That is, the notification to the controller 40 that a user wishes to replace a cartridge is used to initialize the cleaning sequence.

The passive system advantageously uses the spring arm 148 to push the flex circuit 100 toward the main body of the pens 50–56, which further ensures that the nose portion 122 of the flex strip 100 will not inadvertently contact any other printer components while traversing the printzone 25. Another advantage of the passive system 135, besides taking no servicing time to implement, and requiring no firmware or software redesign of the conventional printhead servicing functions of service station 80, the passive method is also quiet. Moreover, as mentioned above, the spatula based bottom portion 152 of the spring arm 148 advantageously shields the majority of the nose portion 122 of the pen flex 100 from having ink residue initially deposited thereon. Finally, the narrow "handle" portion of arms 140–146 above the spatula end 148 advantageously lowers the spring force exerted by the arms to prevent inadvertent damage to the pen flex strips 100, and to minimize the effort required to seat the pens on their alignment datums in the carriage.

Thus, both the active and passive electrical interconnect cleaner systems 125 and 135 advantageously provide the consumer with a more reliable inkjet printer 20, with a prolonged life, even through interchanges of the semi-permanent printhead cartridges 50–56. Furthermore, it is apparent that while the systems 125, 135 have been illustrated with respect to an off-axis inkjet printer 20, the systems may be readily adaptive for use on a replaceable cartridge inkjet printer to remove ink residue from a critical exterior portion of the replaceable cartridges.

We claim:

1. A cleaning system for removing accumulated ink residue from an inkjet cartridge having an electrically conductive contact, a printhead region encompassing print nozzles which eject ink therefrom to print, and a non-printhead exterior region which does not encompass print nozzles or said electrically conductive contact, in a printing mechanism, comprising:

a wiper; and a support member that supports the wiper in a position to remove the accumulated ink residue from the non-printhead exterior region of the cartridge, without contacting the printhead region or said electrically conductive contact, through relative movement of the wiper and the cartridge.

2. A cleaning system according to claim 1 wherein:

the support member comprises a carriage that carries the cartridge;

the non-printhead exterior region of the cartridge comprises a portion of an electrical interconnect; and said relative movement occurs when the cartridge is removed from the carriage.

3. A cleaning system according to claim 2 wherein wiper is of an absorbent material.

4. A cleaning system according to claim 2 wherein:

the support member comprises a spring-biased arm having a proximate end supported by the carriage, and a distal end;

the wiper comprises a wiper head supported by the distal end of the spring-biased arm; and the spring-biased arm urges the wiper head into wiping contact with said portion of the electrical interconnect when the cartridge is removed from the carriage.

5. A cleaning system according to claim 4 wherein the distal end of the spring-biased arm has a shape which shields another portion of the electrical interconnect from ink residue accumulation.

6. A cleaning system according to claim 5, further comprising a shield structure that shields said electrically conductive contact.

7. A cleaning system according to claim 4 wherein wiper head is onsert-molded to the distal end of the spring-biased arm.

8. A cleaning system according to claim 1 wherein:

the support member comprises a moveable platform that supports the support member; and said relative motion is provided by the platform moving the wiper into wiping contact with the non-printhead exterior region of the cartridge to wipe the ink residue therefrom.

9. A cleaning system according to claim 8 wherein:

the non-printhead exterior region of the cartridge comprises a portion of an electrical interconnect; and the wiper has a proximate end supported by the platform, and a distal end that wipes said portion of the electrical interconnect.

10. A cleaning system according to claim 8 wherein the moveable platform also supports at least one printhead servicing component for servicing the print nozzles in the printhead region of the cartridge.

11. A method of cleaning accumulated ink residue from an inkjet cartridge having an electrically conductive contact, a printhead region encompassing print nozzles which eject ink therefrom to print, and a non-printhead exterior region which does not encompass print nozzles or said electrically conductive contact, in a printing mechanism, comprising:

providing a wiper supported by a support member; and in response to an action by a user to remove the cartridge from the printing mechanism, removing the accumulated ink residue from the non-printhead exterior region of the cartridge, without contacting the printhead region or said electrically conductive contact, through relative movement of the wiper and the cartridge.

12. A method according to claim 11 wherein:

the providing step comprises providing the support member as a moveable platform; and the removing step comprises moving the wiper with the platform into wiping contact with the non-printhead exterior region of the cartridge to wipe the ink residue therefrom.

13. A method according to claim 11 for cleaning ink residue from an inkjet cartridge wherein the removing step comprises wiping the wiper across a portion of an electrical interconnect on the inkjet cartridge before removing the cartridge from the printing mechanism.

14. A method according to claim 11 wherein:

said providing comprises providing the support member as a spring-biased arm supported by a carriage that carries the cartridge; and said removing comprises removing the cartridge from the carriage while urging the wiper with the spring-biased arm into wiping contact with the non-printhead exterior region of the cartridge to wipe the ink residue therefrom.

15. A method according to claim 14 wherein:

said providing comprises providing a spring-biased arm which has a distal end with a shape that covers another portion of the electrical interconnect on the inkjet cartridge from ink residue accumulation; and the method further includes shielding said another portion of the electrical interconnect from ink residue accumulation with the distal end of the spring-biased arm.

16. A method according to claim 15, further comprising shielding said electrically conductive contact.

17. A printing mechanism, comprising:

an inkjet cartridge having an electrically conductive contact, a printhead region encompassing print nozzles which eject ink therefrom to print, and a non-printhead exterior region which does not encompass print nozzles or said electrically conductive contact;

an ink residue which accumulates on the non-printhead exterior region of the printhead;

a wiper; and a support member that supports the wiper in a position to remove the accumulated ink residue from the non-printhead exterior region of the cartridge, without contacting the printhead region or said electrically conductive contact, through relative movement of the wiper and the cartridge.

18. A printing mechanism according to claim 17 wherein:

the support member comprises a carriage that carries the cartridge;

the non-printhead exterior region of the cartridge comprises a portion of an electrical interconnect; and said relative movement occurs when the cartridge is removed from the carriage.

19. A printing mechanism according to claim 18 wherein:

the support member comprises a spring-biased arm having a proximate end supported by the carriage, and a distal end;

the wiper comprises a wiper head supported by the distal end of the spring-biased arm; and the spring-biased arm urges the wiper head into wiping contact with said portion of the electrical interconnect when the cartridge is removed from the carriage.

20. A printing mechanism according to claim 19 wherein the distal end of the spring-biased arm has a shape which shields another portion of the electrical interconnect from ink residue accumulation.

21. A printing mechanism according to claim 20, further comprising a shield structure that shields said electrically conductive contact.

22. A printing mechanism according to claim 17 wherein:

the support member comprises a moveable platform that supports the support member; and said relative motion is provided by the platform moving the wiper into wiping contact with the non-printhead exterior region of the cartridge to wipe the ink residue therefrom.

23. A printing mechanism according to claim 22 wherein:

the non-printhead exterior region of the cartridge comprises a portion of an electrical interconnect;

the wiper has a proximate end supported by the platform, and a distal end that wipes said portion of the electrical interconnect; and the moveable platform also supports at least one printhead servicing component for servicing the print nozzles of the printhead region of the inkjet cartridge.

* * * * *